US007174884B2

(12) United States Patent
Kempf et al.

(10) Patent No.: US 7,174,884 B2
(45) Date of Patent: Feb. 13, 2007

(54) TRIGGER ASSEMBLY

(76) Inventors: James J. Kempf, 2926 12th Ave., Ext. NE., Iowa City, IA (US) 52240; Lewis A. Van Winkle, 1207 Highway 16, Hillsboro, IA (US) 52630; Alan Van Winkle, 1207 Highway 16, Hillsboro, IA (US) 52630; Samel Collora, 306 Rosebud Ridge, Mt. Pleasant, IA (US) 52641

( * ) Notice: Subject to any disclaimer, the term of this patent is extended or adjusted under 35 U.S.C. 154(b) by 0 days.

(21) Appl. No.: 11/029,878

(22) Filed: Jan. 5, 2005

(65) Prior Publication Data

US 2006/0144381 A1 Jul. 6, 2006

(51) Int. Cl.
*F41B 5/12* (2006.01)

(52) U.S. Cl. ..... 124/25; 124/40

(58) Field of Classification Search ..... 124/25, 124/40

See application file for complete search history.

(56) References Cited

U.S. PATENT DOCUMENTS 4,030,473 A * 6/1977 Puryear ..... 124/35.1
4,192,281 A * 3/1980 King ..... 124/25
4,766,874 A 8/1988 Nishioka
4,879,987 A 11/1989 Nishioka
4,976,250 A 12/1990 Jeffrey
5,115,795 A * 5/1992 Farris ..... 124/86
5,215,069 A * 6/1993 Liu ..... 124/25
5,368,006 A 11/1994 McPherson
5,598,829 A * 2/1997 Bednar ..... 124/25
5,630,405 A 5/1997 Nizov
5,649,520 A * 7/1997 Bednar ..... 124/25
6,205,990 B1 * 3/2001 Adkins ..... 124/25
6,267,108 B1 7/2001 McPherson et al.
6,460,528 B1 10/2002 Gallops, Jr.

* cited by examiner

*Primary Examiner*—John A. Ricci
(74) *Attorney, Agent, or Firm*—Brett Trout

(57) ABSTRACT

A crossbow having an improved firing assembly. The improved assembly attaches to a bowstring at a single point and draws the string back to have the string retained between a first string retainer and a second string retainer. By allowing the string to be drawn utilizing a single contact point on the bowstring as opposed to the prior art methods of dual engagement points with the bowstring, the cost, maintenance and undesired variance in string retention associated with the prior art are substantially eliminated.

19 Claims, 9 Drawing Sheets

TRIGGER ASSEMBLY

BACKGROUND OF THE INVENTION

1. Field of the Invention

The present invention relates in general to an improved trigger assembly and, more particularly, to an improved trigger assembly for a crossbow.

2. Description of the Prior Art

Crossbows have been known for centuries. By allowing the shooter to mechanically retain the bow in a cocked position, the shooter is provided an advantage over a traditional archer who must utilize muscular force to retain the bow in the cocked position. In a typical crossbow assembly, a cocking mechanism is utilized whereby two hooks are applied to the bowstring to draw the bowstring rearward into engagement with a retainer pin or other device utilized to retain the bowstring in the cocked position until the trigger is pulled. The necessity of the dual attachment points to the bow during cocking is a drawback associated with the prior art.

As crossbows typically utilize very strong limbs, the bowstring is under very high pressure, requiring firm engagement between the seer and the trigger assembly. These high pressures associated with prior art devices and the solid engagement of the seer with the trigger assembly often results in an undesirably hard and rough trigger pull. It would, therefore, be desirable to provide a firing assembly which allowed a single attachment point to the bow during cocking, which provided for a lighter, smoother trigger pull and which maintained safety against unintentional launch of a projectile from the crossbow. The difficulties encountered in the prior art discussed hereinabove are substantially eliminated by the present invention.

SUMMARY OF THE INVENTION

In an advantage provided by this invention, a crossbow is provided with an improved firing assembly which is of a low-cost, simple manufacture.

Advantageously, this invention provides a crossbow with an improved firing assembly which allows for a smoother trigger pull.

Advantageously, this invention provides a crossbow with an improved firing assembly with a lighter trigger pull.

Advantageously, this invention provides a crossbow with an improved firing assembly with reduced weight and maintenance characteristics.

Advantageously, this invention provides a crossbow with an improved firing assembly with improved safety characteristics.

Advantageously, this invention provides a crossbow with an improved firing assembly with an integrated dryfire prevention system.

Advantageously, in the preferred embodiment of this invention, a shooting bow is provided with a frame, a bow, and a string provided on the bow. Means are provided for engaging the string at a first point and for drawing the string into a cocked position. Means are also provided for retaining the string at the first point. A trigger is provided, as is means for releasing the retaining means from the string upon actuation of the trigger. Preferably, the retainer includes a first string retainer and a second string retainer which maintains the first point of the string in a cocked position between the first string retainer and the second string retainer.

BRIEF DESCRIPTION OF THE DRAWINGS

The present invention will now be described, by way of example, with reference to the accompanying drawings in which:

FIG. 7 illustrates a side elevation of the locking mechanism of FIG. 5, shown with the locking mechanism in the cocked position;

DETAILED DESCRIPTION OF THE PREFERRED EMBODIMENT

Figure 1:
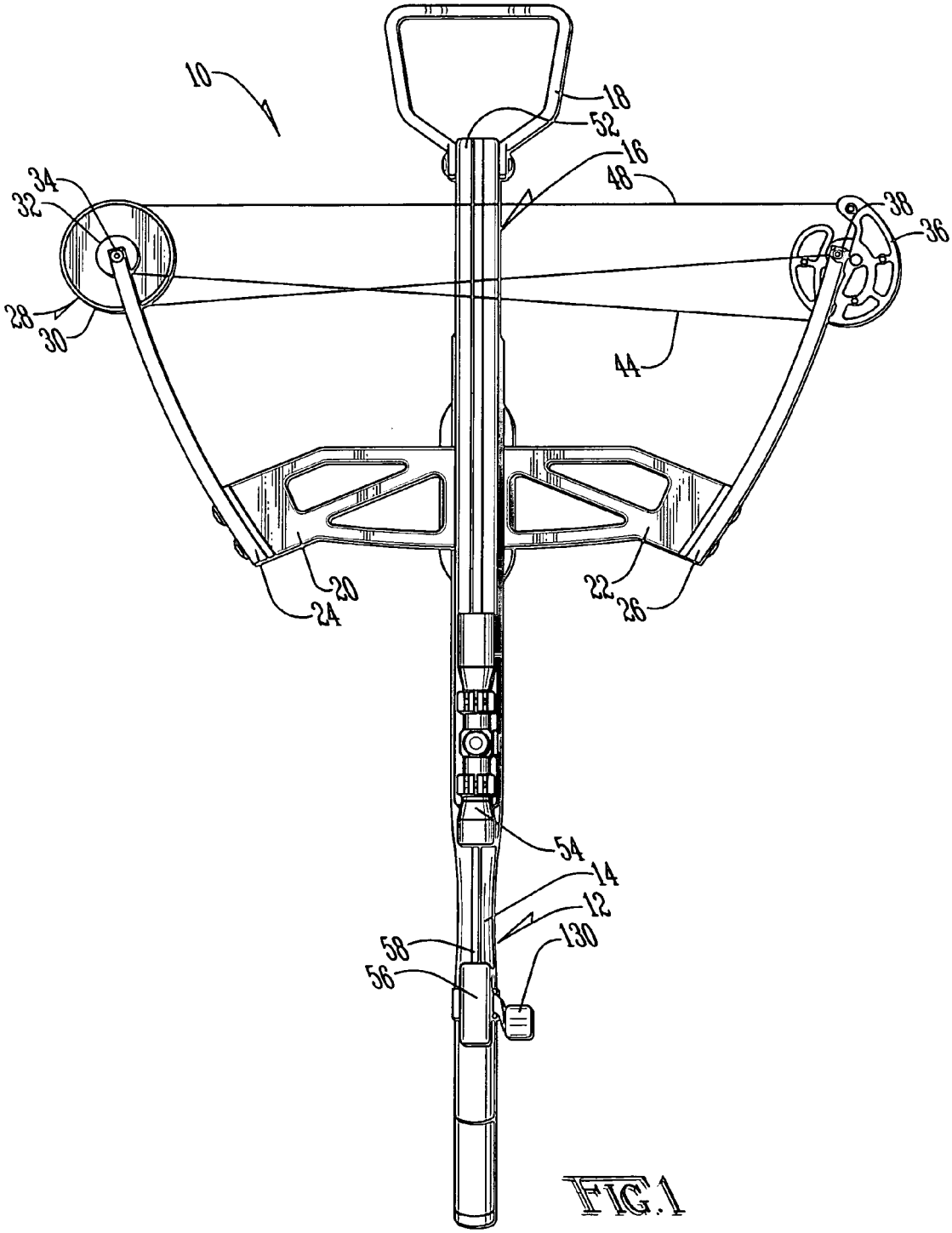
FIG. 1 illustrates a top plan view of the crossbow of the present invention.
Figure 2:
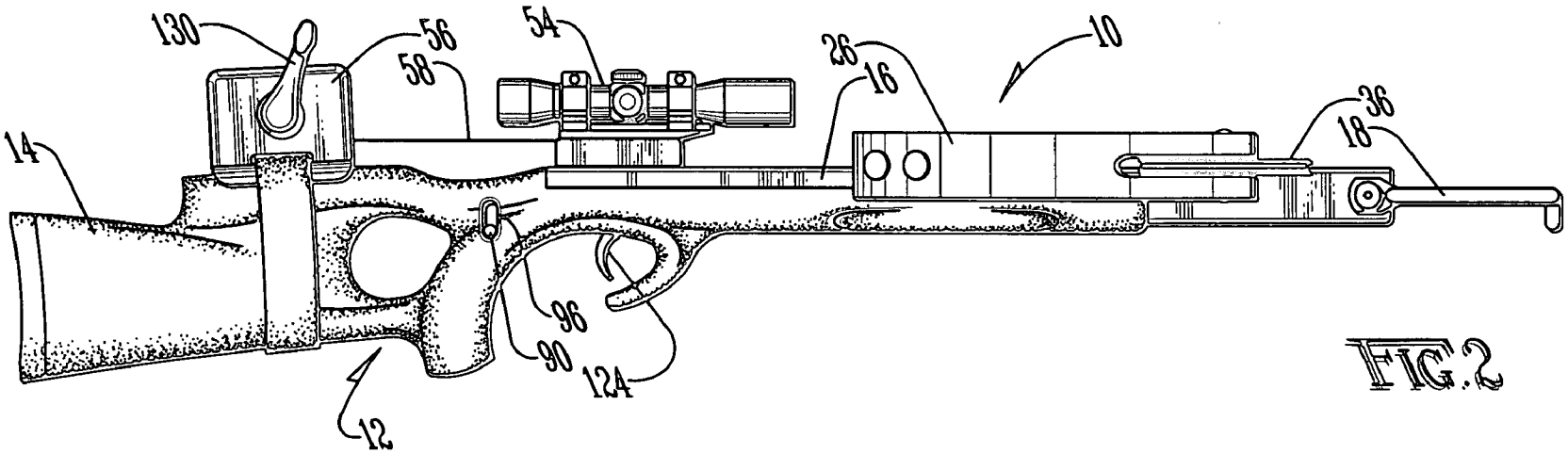
FIG. 2 illustrates a side elevation of the crossbow of FIG. 1.

A crossbow according to the present invention is shown generally as (10) in FIG. 1. As shown in FIGS. 1 and 2, the crossbow (10) is provided with a frame (12) which includes a stock (14) and a rail (16). Although the stock (14) and rail (16) may be of any type known in the art, in the preferred embodiment the stock (14) is of a composite material construction, and the rail (16) is constructed of aluminum. Alternatively, the crossbow (10) may be of a "railless" design, such as those known in the art.

Figure 3:
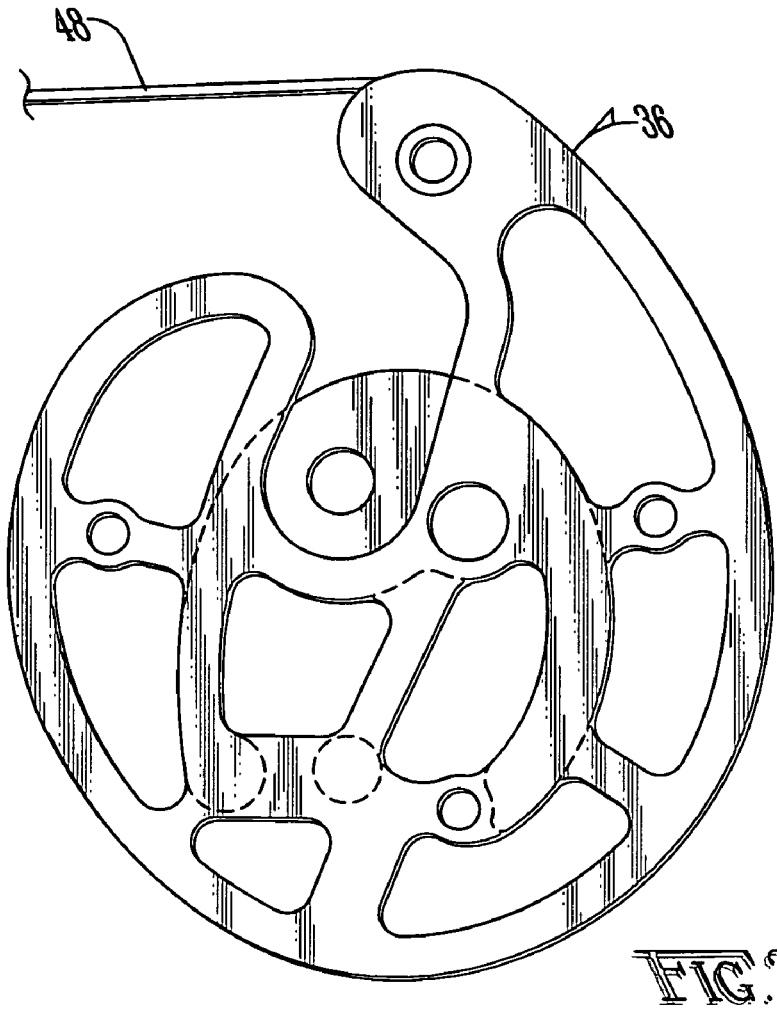
FIG. 3 illustrates a bottom plan view of the cam associated with the crossbow of FIG. 1.

The crossbow (10) is provided with a pivotable foot stirrup (18) to facilitate cocking of the crossbow (10). As shown in FIG. 1, the crossbow (10) is also provided with a pair of risers (20) and (22) secured to the rail (16). The risers (20) and (22) are preferably constructed of aluminum to reduce weight. Coupled to the risers (20) and (22) are limbs (24) and (26). The limbs (24) and (26) are constructed and coupled to the risers (20) and (22) in a manner such as that known in the art. Coupled to the first limb (24) is a first string guide, which in the preferred embodiment is a pulley (28), having an outer track (30) and an inner track (32). The pulley (28) is preferably journaled to the end of the limb (24) by an axle (34). The pulley (28) is preferably journaled to the limb (24) in a manner which positions a portion of the pulley (28) forward and outward of the space defined between the limbs (24) and (26). As shown in FIG. 1, a second string guide, which in the preferred embodiment is a cam (36), is journaled to the second limb (26) by an axle (38). The cam (36) is also journaled to the second limb (26) so that at least a portion of the cam (36) extends forward and outward of the area defined between the limbs (24) and (26). The cam (36) is preferably constructed as shown in FIG. 3, but may be constructed in a manner known in the art.

If desired, two synchronized cams (not shown) may be used in place of the cam (36) and pulley (28). The cam (36) and pulley (28) may be coupled to a bowstring (48) and, if desired, one or more cables in any manner known in the art, but the bowstring (48) is preferably located, as shown in FIG. 1, forward of the points on the limbs (24) and (26) where the cam (36) and pulley (28) are journaled to the limbs (24) and (26).

Figure 4:
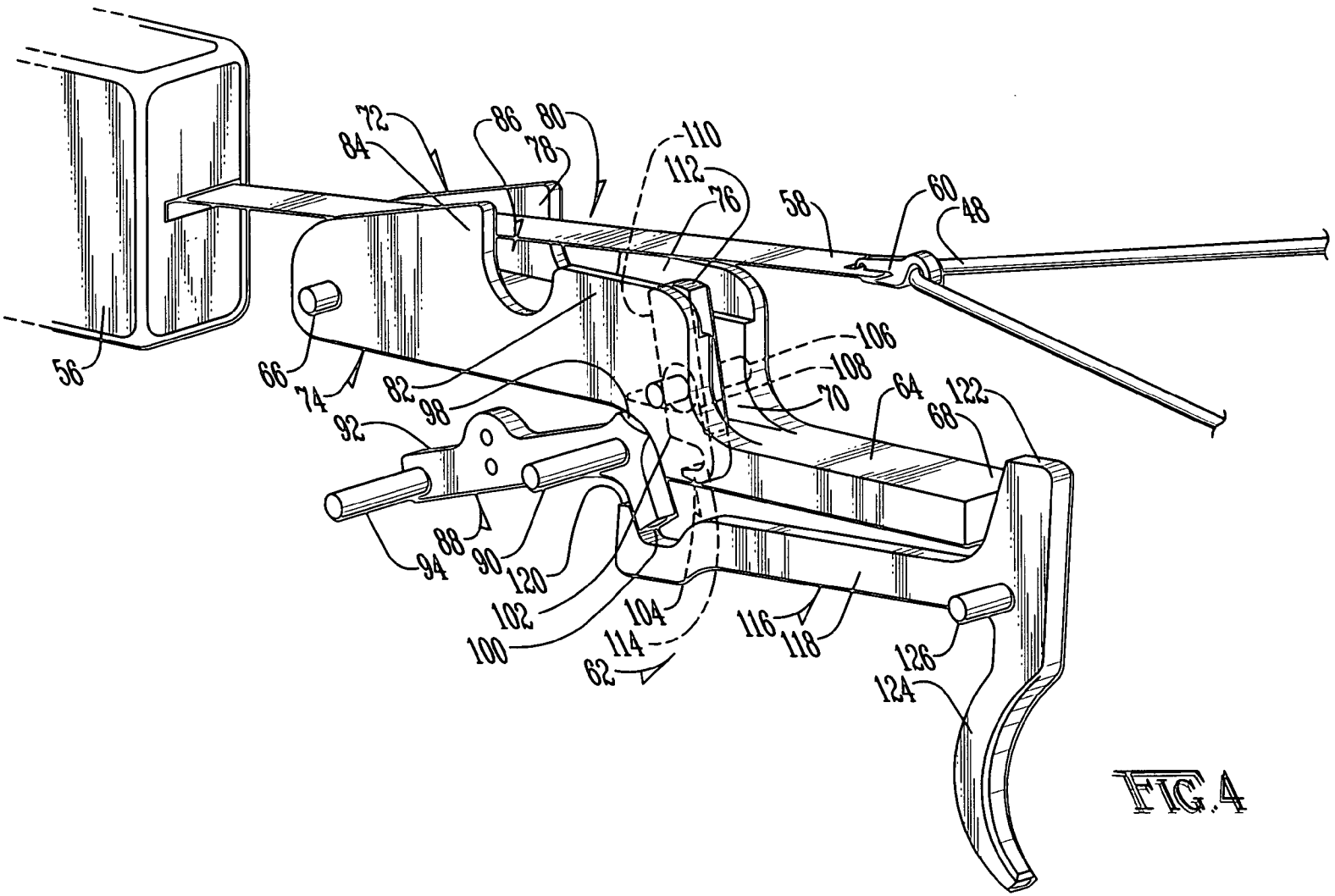
FIG. 4 illustrates a side perspective view of the locking mechanism of the present invention.

As shown in FIG. 1, the foregoing orientation of the pulley (28), cam (36), cable (44) and bowstring (48) positions the bowstring (48) very close to the forward end (52) of the rail (16). As shown in FIG. 2, secured above the rail (16) is a scope (54). Releasably secured to the stock (14) is a cocker mechanism (56), such as those known in the art. Alternatively, a cocker mechanism may be integrated into the frame (12). Extending from the cocker mechanism (56) is a band (58) used to draw the bowstring (48). As shown in FIG. 4, however, unlike prior art cocking strings, the band (58) is provided with a single attachment point hook (60) to engage the bowstring (48). The cocker mechanism (56) may be of an ordinary dog and pawl construction, or any similarly suitable construction designed to retract the band (58).

As shown in FIG. 4, the cocker mechanism (56) draws the band (58) over a locking assembly (62). The locking assembly (62) includes a retainer bar (64), a safety assembly (88), a dryfire bar (104) and a trigger assembly (116). The retainer bar (64) is pivotally mounted to the frame (12) by an axle (66). FIGS. 2 and 4. The retainer bar (64) is preferably constructed of hardened steel and is journaled to the frame (12) preferably at a point at least ten centimeters, more preferably at least twelve centimeters, and most preferably at least fourteen centimeters from sear (68) which forms the end of the retainer bar (64).

As shown in FIG. 4, the retainer bar (64) is provided with a slot (70) defined by a left wall (72) and a right wall (74). The left wall (72) includes a left string retainer (76) and a left string engager (78). The string retainer (76) and string engager (78) define a left string slot (80) therebetween. Similarly, the right wall (74) includes a right string retainer (82) and a right string engager (84) coacting to define a right string slot (86).

As shown in FIG. 4, the safety assembly (88) is pivotally coupled to the frame (12) by an axle (90). The safety assembly (88) includes a hardened steel safety bar (92) coupled to an actuation pin (94) which extends through a slot (96) provided in the stock (14). FIGS. 2 and 4.

Figure 5:
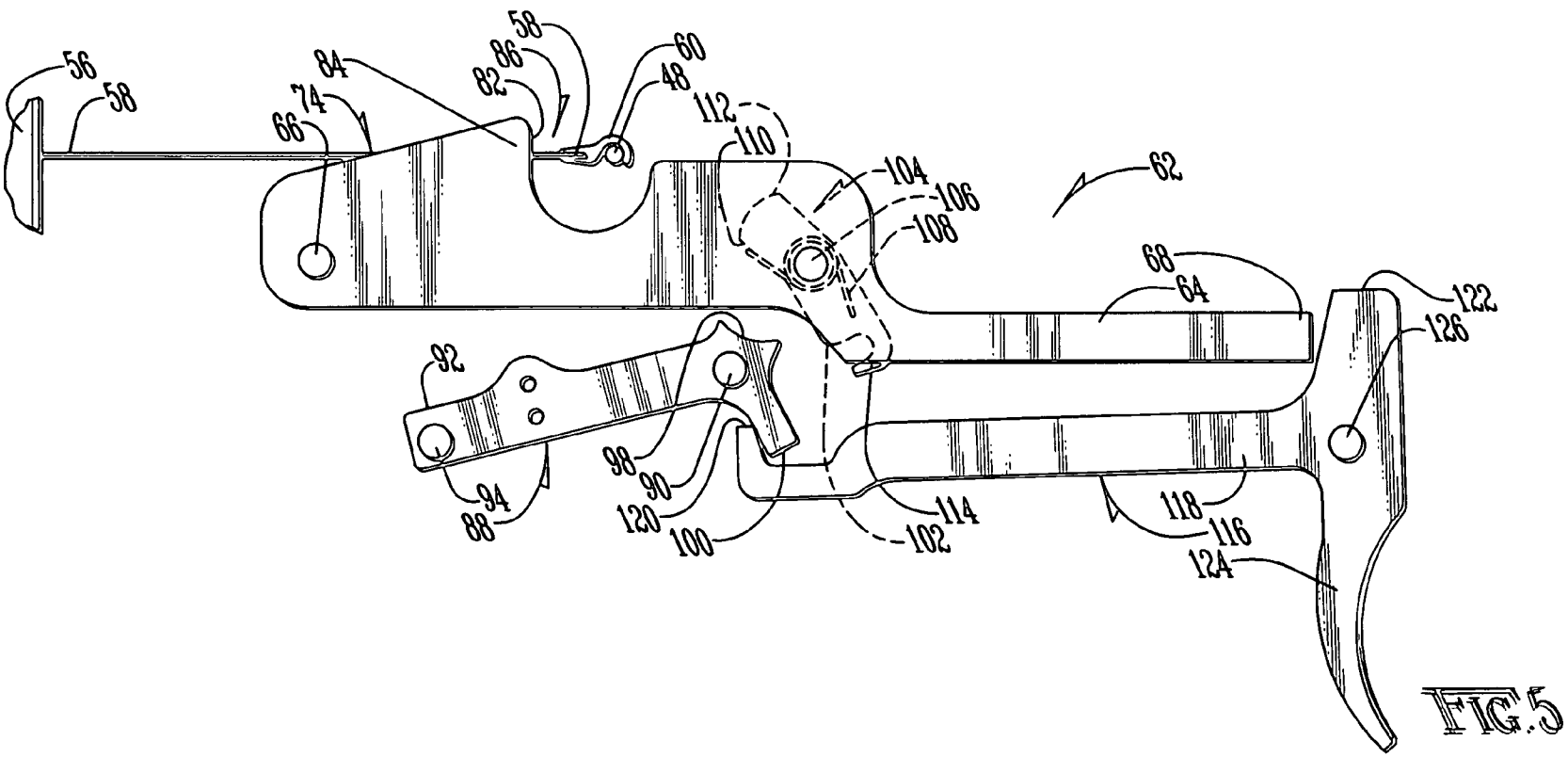
FIG. 5 illustrates a side elevation of the locking mechanism of the present invention, shown with the bowstring drawn between the string retainers.

As shown in FIG. 5, the safety bar (92) defines a dryfire catch (98) and a trigger bar sear (100). The dryfire catch (98) is preferably provided with an arcuate surface as shown in FIG. 5 to accommodate the curved end (102) of the dryfire bar (104). As shown in FIGS. 4 and 5, the dryfire bar (104) is pivotally coupled to the retainer bar (64) by an axle (106). The dryfire bar (104) preferably rests within the slot (70) defined by a left wall (72) and right wall (74) of the locking assembly (62). (FIGS. 4–5). As shown in FIG. 5, a torsion spring (108) may be secured to the left wall (72) and right wall (74). As shown, the torsion spring (108) wraps around the axle (106) on either side of the dryfire bar (104) and wraps around the back (110) of the dryfire bar (104) to motivate the dryfire bar (104) toward an upright position. Any type of spring, or even gravity, may be utilized to motivate the dryfire bar (104) toward an upright position. As shown in FIG. 5, the dryfire bar (104) is provided on one end with a projectile engager (112) and on the opposite end with a hook (114).

As shown in FIG. 5, the trigger assembly includes a trigger bar (118), a safety engager (120), a sear engager (122) and a trigger (124), all integrally formed from a single piece of hardened steel. The trigger assembly (116) is journaled to the frame (12) by an axle (126). FIGS. 2 and 5. The extended length of the retainer bar (64) and trigger bar (118) are preferred as this construction reduces wear on the sears (68) and (100), extends the life of the parts, and provides a lighter trigger pull, while still maintaining safety of the mechanism. Additionally, by locating the string retainers (76) and (82) rearward of the trigger (124), an increased power stroke is available, allowing the crossbow (10) to store and deliver more energy to a projectile.

As shown in FIG. 5, the trigger assembly (116) is journaled to the frame (12) in a manner which motivates the trigger assembly (116) in a counterclockwise rotation, given the weight distribution of the elements of the trigger assembly (116) relative to the axle (126). Preferably, the trigger assembly (116) is provided with a set screw (not shown) to allow for trigger pull adjustment in a manner such as that known in the art.

Figure 6:
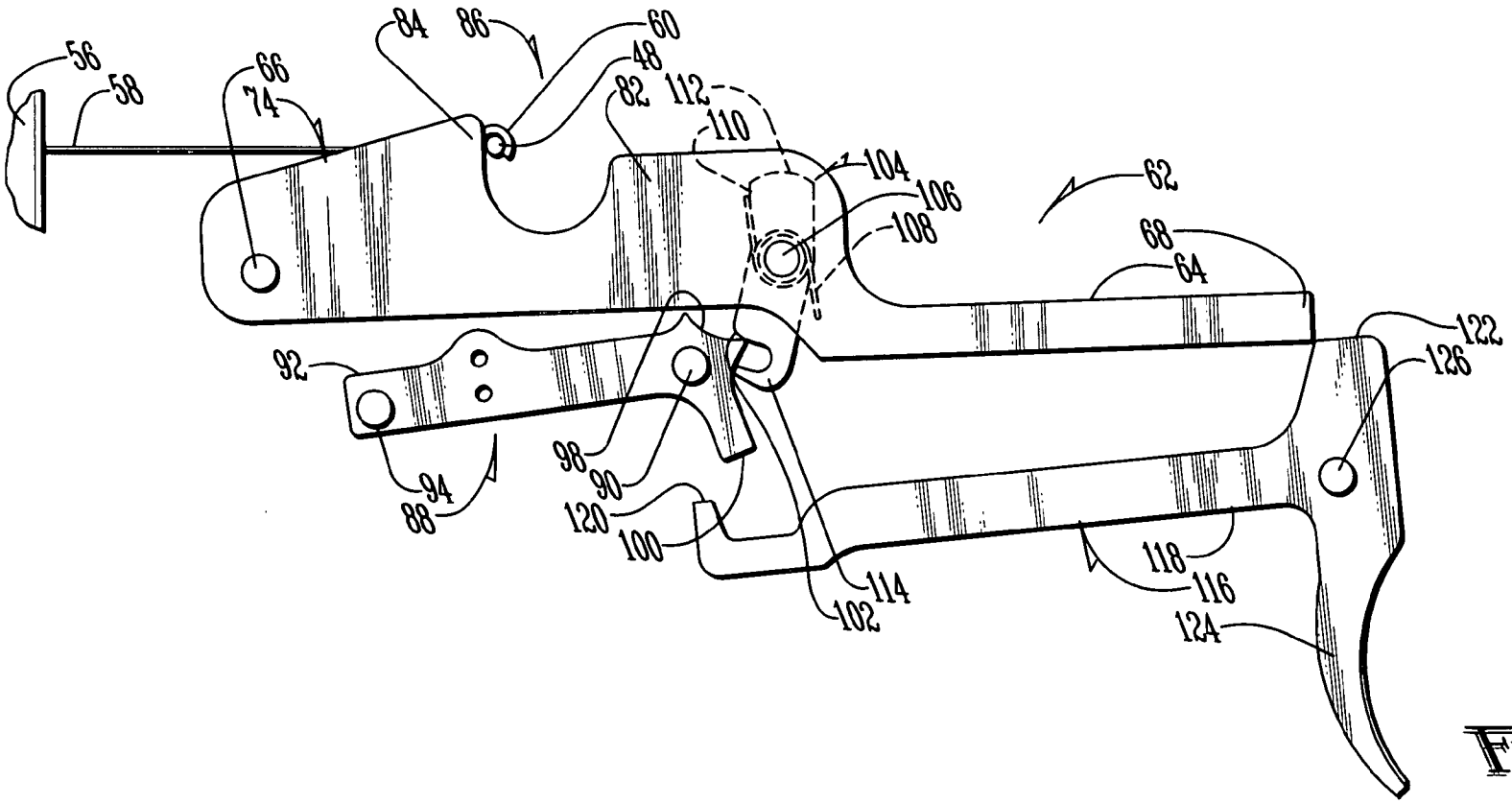
FIG. 6 illustrates a side elevation of the lock assembly of FIG. 5, shown with the string engaging the rear of the retainer bar.
Figure 4:
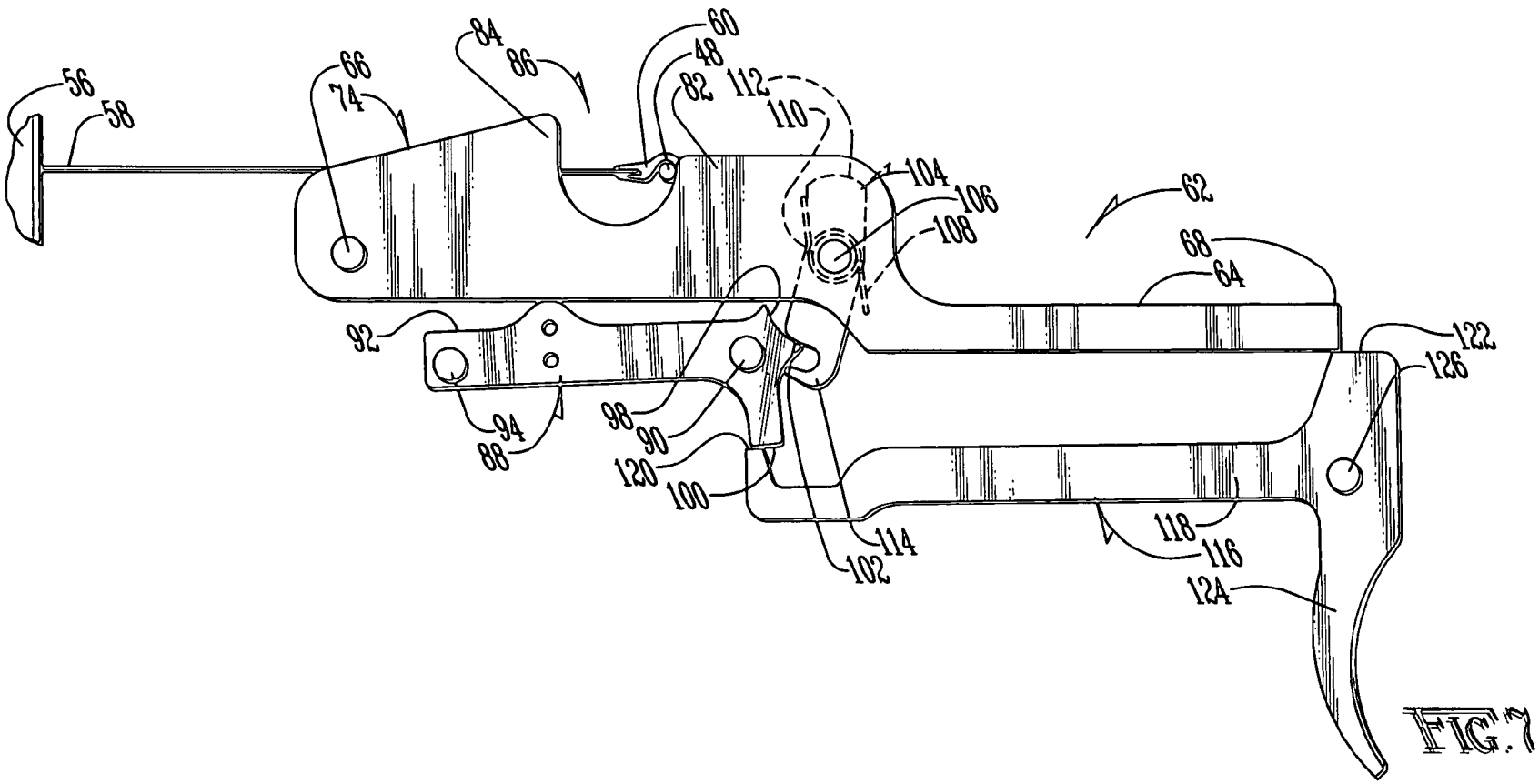

When it is desired to load and fire the crossbow (10), the cocker mechanism (56) is released to allow the band (58) and hook (60) to be extended and engaged with the bowstring (48). The cocker mechanism (56) is thereafter actuated utilizing the handle (130), a power drill (not shown), or any other suitable means known in the art to begin retracting the band (58) and hook (60) toward the cocker mechanism (56). As shown in FIG. 4, as the cocker mechanism (56) draws the bowstring (48) rearward, the band (58) passes between the downwardly rotated string retainers (76) and (82). As shown in FIG. 5, as the cocker mechanism (56) retracts the bowstring (48), the trigger assembly (116) is in the fired position, having previously released the sear (68) from the sear engager (122). This causes the retainer bar (64) to pivot downward, creating the required clearance between the hook (60) and the tops of the string retainers (76) and (82). As shown, the safety assembly (88) is disengaged, allowing the trigger bar (118) to pivot past the trigger bar sear (100) and to allow the curved end (102) of the dryfire bar (104) to move past the dryfire catch (98). As shown in FIG. 6, as the cocker mechanism (56) continues to draw the bowstring (48) rearward, the bowstring (48) contacts the string engagers (78) and (84). (FIGS. 4 and 6). As the cocker mechanism (56) continues to exert force against the string engagers (78) and (84) via the bowstring (48), the retainer bar (64) begins to rotate counterclockwise, raising the sear (68) above the sear engager (122). The weight of the trigger assembly (116) rotates the sear engager (122) under the sear (68). Additionally, the hook (114) associated with the dryfire bar (104) engages the safety bar (92).

Thereafter, as the cocker mechanism (56) is actuated to release the bowstring (48), the band (58), hook (60) and bowstring (48) move forward as shown in FIG. 7. As pressure is released from the string engagers (78) and (84), the retainer bar (64) rotates clockwise under the force of gravity to move the sear (68) into engagement with the sear engager (122) and to cause the trigger bar sear (100) to move into engagement with the safety engager (100). Additionally, the curved end (102) of the dryfire bar (104) moves into engagement with the dryfire catch (98). In this orientation, the safety assembly (188) prevents actuation of the trigger assembly (116) as the bowstring (48) continues to move forward into contact with the string retainers (76) and (82). Because there are two retainers (76) and (82), located on either side of the hook (60), a single hook may be utilized instead of prior art utilization of a dual hook assembly. This orientation not only reduces parts and increases the repeatability of the draw, it also reduces stress on the nock point of the bowstring (48).

Figure 8:
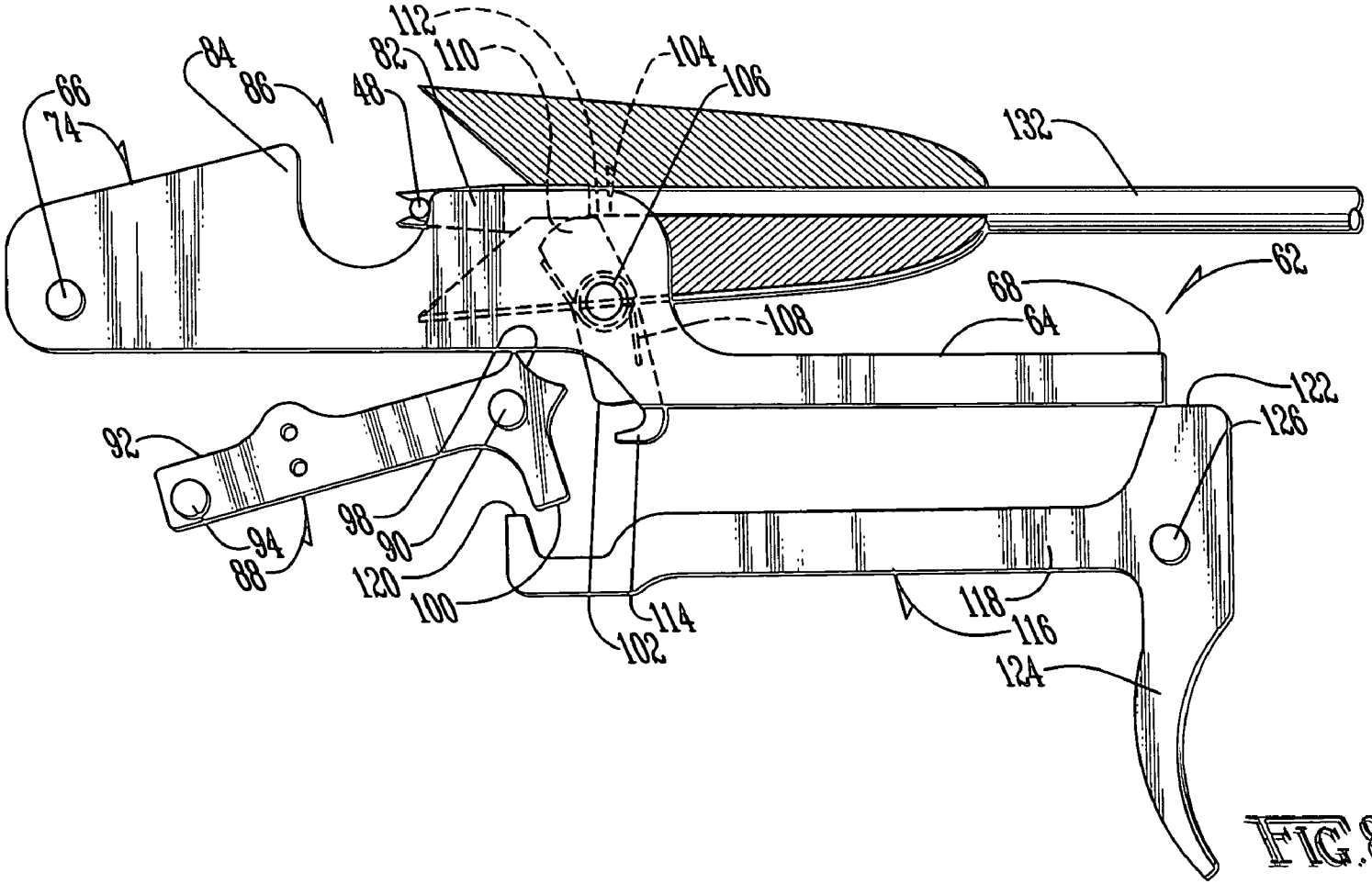
FIG. 8 illustrates a side elevation of the locking mechanism of FIG. 5, shown with a projectile positioned between the string retainers and the safety released.
Figure 9:
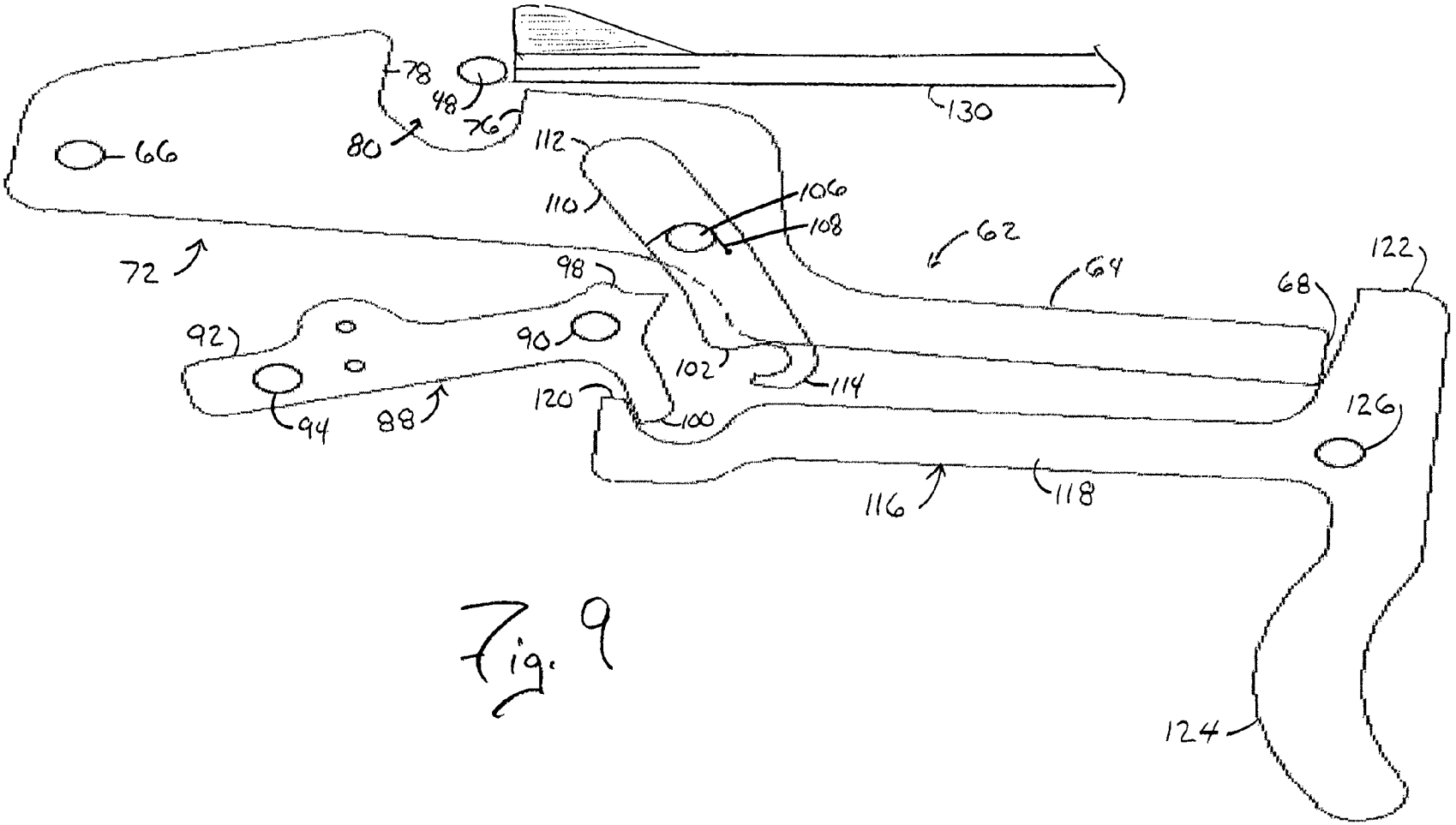
FIG. 9 illustrates a side elevation of the locking mechanism of FIG. 5, shown with the trigger actuated and the bowstring released from the retainer bar.

After the crossbow (10) has been cocked as described above, a projectile such as an arrow (130) is positioned along the rail (16) as shown in FIG. 8. (FIGS. 1 and 8.) Given the increased power stroke of the present invention, standard arrows may be used in place of standard crossbow bolts. As shown, placement of the arrow (130) between the left wall (72) and right wall (74) of the locking assembly (62) forces the projectile engager (112) portion of the dryfire bar (104) downward and rearward, causing the dryfire bar (104) to rotate out of engagement with the safety assembly (88). (FIGS. 4 and 8). Thereafter, the actuation pin (94) of the safety assembly (88) may be actuated to rotate the safety assembly (88) from the safe position to the fire position as shown in FIG. 8.

When it is desired to fire the crossbow (10), the trigger (124) is moved rearward, causing the sear engager (122) of the trigger assembly (116) to rotate out of engagement with the sear (68), and allowing the retainer bar (64) to rotate clockwise, thereby allowing the bowstring (48) to release from the string engagers (78) and (84) and propel the arrow (130) forward.

Although the invention has been described with respect to a preferred embodiment thereof, it also to be understood it is not to be so limited, since changes and modifications can be made therein which are within the full, intended scope of this invention as defined by the appended claims. As an example, the locking mechanism described above may be constructed of any suitable parts and any suitable dimensions.

What is claimed is:

1. A shooting bow comprising:
(a) a frame;
(b) a bow;
(c) a string provided on said bow;
(d) a first string retainer;
(e) a second string retainer
(f) means provided between said first string retainer and said second string retainer for engaging said string at a first point along said string;
(g) means coupled to said engaging means for drawing said string;
(h)
(i) a trigger; and
(j) means coupled to said first string retainer, said second string retainer and said trigger for releasing said first string retainer and said second string retainer from said string upon actuation of said trigger.

2. The shooting bow of claim 1 wherein said first string retainer and said second string retainer are rigidly secured to one another.

3. The shooting bow of claim 1 wherein said first string retainer and said second string retainer define an interstice, and wherein said first string retainer and said second string retainer retain said first point of said string in said interstice.

4. A shooting bow comprising:
(a) a frame;
(b) a bow;
(c) a string provided on said bow;
(d) means for engaging said string at a first point along said string;
(e) means coupled to said engaging means for drawing said string;
(f) means for retaining said string at said first point;
(g) a trigger;
(h) means coupled to said retaining means and said trigger for releasing said retaining means from said string upon actuation of said trigger; and
(i) means positioned between said first string retainer and said second string retainer for preventing actuation of said trigger until a projectile is positioned between said first string retainer and said second string retainer.

5. The shooting bow of claim 4, wherein said preventing means comprises a block pivotally coupled to said shooting bow.

6. The shooting bow of claim 4, further comprising means for pivoting said retaining means into a path of said string.

7. The shooting bow of claim 4, further comprising means for pivoting said retaining means into a path of said string in response to pressure exerted on said pivoting means by said string.

8. A shooting bow comprising:
(a) a frame;
(b) a bow;
(c) a string provided on said bow;
(d) means for engaging said string at a first point along said string;
(e) means coupled to said engaging means for drawing said string;
(f) means for retaining said string at said first point;
(g) a trigger;
(h) means coupled to said retaining means and said trigger for releasing said retaining means from said string upon actuation of said trigger;
(i) a first string contact and a second string contact; and
(j) means for pivoting said retaining means into a path of said string in response to pressure being exerted on said first string contact and said second string contact.

9. The shooting bow of claim 8, wherein said retaining means comprises a first string retainer and a second string retainer.

10. The shooting bow of claim 9, wherein said first string contact, said second string contact, said first string retainer and said second string retainer are all rigidly coupled to one another.

11. A shooting bow comprising:
(a) a frame;
(b) a bow;
(c) a string provided on said bow;
(d) a first string retainer;
(e) a second string retainer;
(f) means for engaging said string;
(g) means for drawing said engaging means between said first string retainer and said second string retainer;
(h) a trigger;
(i) means coupled to said first string retainer, said second string retainer and said trigger for releasing said string from said first retainer and said second retainer upon actuation of said trigger.

12. The shooting bow of claim 11, further comprising means positioned between said first string retainer and said second string retainer for preventing actuation of said trigger until a projectile is positioned between said first string retainer and said second string retainer.

13. The shooting bow of claim 12, wherein said preventing means comprises a block pivotally coupled to said shooting bow.

14. The shooting bow of claim 11, further comprising means for pivoting said first string retainer and said second string retainer into a path of said string.

15. The shooting bow of claim 11, further comprising means for pivoting said first string retainer and said second string retainer into a path of said string in response to pressure exerted on said pivoting means by said string.

16. The shooting bow of claim 15, wherein said pivoting means comprises a first string contact and a second string contact.

17. A shooting bow comprising:

(a) a frame defining a projectile path;

(b) a bow;

(c) a string provided on said bow;

(d) a string retainer;

(e) a trigger;

(f) means coupled to said string retainer for releasing said string retainer from said string upon actuation of said trigger; and (g) means coupled to said releasing means below said string for preventing actuation of said trigger until a projectile is placed in said projectile path.

18. The shooting bow of claim 17, further comprising a safety, wherein said trigger actuation preventing means comprises means for preventing actuation of said safety until a projectile is placed in said projectile path.

19. The shooting bow of claim 17, wherein said trigger actuation preventing means comprises:

(a) a block pivotably coupled for movement into and out of a path of said string, wherein said block is of a sufficient configuration and design to prevent firing of said string when said block is in said path of said string; and (b) means for moving said block out of a path of said string in response to the positioning of a projectile on said projectile path.

* * * * *